US006059179A

United States Patent [19]

Giampapa

[11] Patent Number: 6,059,179

[45] Date of Patent: May 9, 2000

[54] MULTI-USE CONFIGURABLE CONTAINER

[76] Inventor: Debbie L. Giampapa, 47 Alcoba, Irvine, Calif. 92614

[21] Appl. No.: 09/062,311

[22] Filed: Apr. 17, 1998

[51] Int. Cl.[7] ..... B65D 5/42

[52] U.S. Cl. ..... 229/103; 206/457; 206/549; 229/116.1; 229/117.15

[58] Field of Search ..... 229/103, 116.1, 229/117.15, 902, 157; 206/459.5, 541, 542, 549, 457

[56] References Cited

U.S. PATENT DOCUMENTS

| | | | |
|---|---|---|---|
| 1,129,343 | 2/1915 | Gale | 229/103 |
| 1,467,690 | 9/1923 | Schwarz | 229/103 |
| 1,956,572 | 5/1934 | Grossen | 229/103 |
| 2,680,047 | 6/1954 | Frum | 229/103 |
| 2,805,813 | 9/1957 | Rittmueller | 229/117.15 |
| 2,831,624 | 4/1958 | Lever . | |
| 3,097,782 | 7/1963 | Koropatkin et al. | 229/103 |
| 3,373,922 | 3/1968 | Watts | 229/103 |
| 3,375,008 | 3/1968 | Atkinson | 229/103 |
| 3,627,541 | 12/1971 | Farquhar | 229/103 |
| 3,747,832 | 7/1973 | Chapman . | |
| 4,337,812 | 7/1982 | Trinkner | 206/541 |
| 4,648,548 | 3/1987 | Shin | 229/103 |
| 4,712,673 | 12/1987 | Moore | 206/542 |
| 4,806,397 | 2/1989 | Horwitz | 229/103 |
| 5,042,715 | 8/1991 | McNeill | 229/117.15 |
| 5,074,460 | 12/1991 | Hanekamp | 229/117 |

*Primary Examiner*—Gary E. Elkins
*Attorney, Agent, or Firm*—Gene Scott-Patent Law & Venture Group

[57] ABSTRACT

A container may be folded into a configuration for a shipping container, a configuration for a picnic basket, and a configuration for a eating upon as a mat. The container may have a table cloth indicia depicted on its interior surface or a game board indicia or other printed matter. A top portion of the container may be configured as a handle for carrying the container or as a flat top for shipping. Certain portions of the container may be scored or perforated for easy removal in order to better adapt the mat as an eating surface.

13 Claims, 3 Drawing Sheets

MULTI-USE CONFIGURABLE CONTAINER

BACKGROUND OF THE INVENTION

1. Field of the Invention

This invention relates generally to containers, and more particularly to a multi-use container configurable in several ways for adaptation to various objectives.

2. Description of Related Art

The following art defines the present state of this field:

Hanekamp, U.S. Pat. No. 5,074,460 describes a generally rectangular container fabricated of, for example, a heavy paper material such as pressed paper board or corrugated cardboard, includes an inner, flexible moisture impermeable bag. The container is constructed so that the side walls, end walls, bottom wall and top wall are foldable to form a thin, flat stack having a rectangular perimeter when not in use for easy storage, and which can be formed into a strong container without the use of fasteners or adhesives.

Chapman, U.S. Pat. No. 3,747,832 describes a food carrying paper box in which four side sections and a bottom section together with interlocking connecting sections between the side sections from an octagon with punched out lock sections on two of the side sections. A section contiguous with one of the side sections which forms a top section of the box and has rounded locking tabs extending thereform on two of the sides for cooperation with the lock sections. The edge of the top section opposite the edge contiguous with an edge of one of the side sections is attached to the opposite edge of an opposite side section by a glue flap which is perforated for removal of the top section upon opening the box. The entire top section including the rounded locking tabs being folded underneath sections forming the octagon resulting in a convenient place mat.

S. Koropatkin et al., U.S. Pat. No. 3,097,782 relates to a picnic device which is convertible from a transporting container to a stationary table setting. The device of the present invention comprises, initially, a substantially rectangular or square, stiff or semi-stiff cardboard flat sheet or the like, which, by means of properly arranged fold lines can be transformed into a box container, and vice-versa. The particular fold lines are arranged in such a manner that corner portions of the sheet are formed into wing folds which enable the sheet readily to assume a box-like shape and which enwrap the container to enhance its load strength. Furthermore, a novel arrangement of apertures and sliding cords therein is provided whereby the pulling of the cords automatically transforms the sheet into a carrying container which can then be carried by said cords serving as a shoulder strap or as hand carrying means. By virtue of the novel arrangement of fold lines, apertures, and lacing of the cords in the sheet, there is provided a device that is initially useful for carrying food, beverages, and picnic and beach paraphernalia to the picnic or beach site where the device is readily converted to a flat dining surface either on a table or on the ground. After it has served its purposes in the flat condition, the device is readily refoldable by operation of the carrying cords into a container which may function either to carry the paraphernalia away again, or in which table scraps and other waste matter may be carried for disposal in a refuse can or incinerator.

G. Grossen, U.S. Pat. No. 1,956,572 relates to containers, and especially to a container which constitutes a sanitary dining table service. It further relates to an improved container which holds silverware, napkin and other accessories when closed, and which when unfolded serves as a pad or mat on which hot dishes are placed for protecting the table from the effects of heat therefrom.

H. D. Frum, U.S. Pat. No. 2,680,047 relates to new and useful improvements in inexpensive disposable tables intended particularly for use at beaches. However, these tables may also be used at picnics and other places. An important object of this invention resides in the construction of a beach table of cardboard, corrugated board, etc., which, when not in use may be opened flat and which may be easily and quickly folded and assembled into the table form. It is proposed to so construct the new table that when assembled it is very strong and may support jugs of liquid, dishes and foods.

K. C. Lever, U.S. Pat. No. 2,831,624 relates to a combined lunch bag and napkin cloth wherein the device is folded to make an ample sized lunch bag, and when open serves as a cloth or napkin to lay food on while eating. An object of this invention is to provide a combined lunch bag and napkin cloth which may be utilized for carrying the lunch and spreading for forming a napkin and then folding for carrying in a suitable hand bag. A further object of this invention is to provide a combined lunch bag and napkin cloth which may be used over and over, depending upon the construction and materials used therein.

The prior art teaches multi-use containers for use as a combination picnic basket and eating surface. Such container are shown which fold in certain ways as to enable the container to have dual or multiple functions. However, the prior art does not teach that a combination container may be configure for shipping, carrying and as an eating mat. The prior art also does not teach the many uses for a container as a combination carry-all and work mat. The present invention fulfills these needs and provides further related advantages as described in the following summary.

SUMMARY OF THE INVENTION

The present invention teaches certain benefits in construction and use which give rise to the objectives described below.

The present invention provides a container that may be folded into a configuration as a shipping container, a configuration for a picnic basket, and a configuration for a eating upon as a mat. The container may have a table cloth indicia depicted on its interior surface or a game board indicia or other printed matter. A top portion of the container may be configured as a handle for carrying the container or as a flat top for shipping. Certain portions of the container may be scored or perforated for easy removal in order to better adapt the mat as an eating surface.

A primary objective of the present invention is to provide a container having advantages not taught by the prior art.

Another objective is to provide such a container that is convertible for use as a shipping container, a carrying container and as a mat for eating upon.

A still further objective is to provide such a container that may be used as a game board or for supporting and directing arts and crafts activities.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 2:
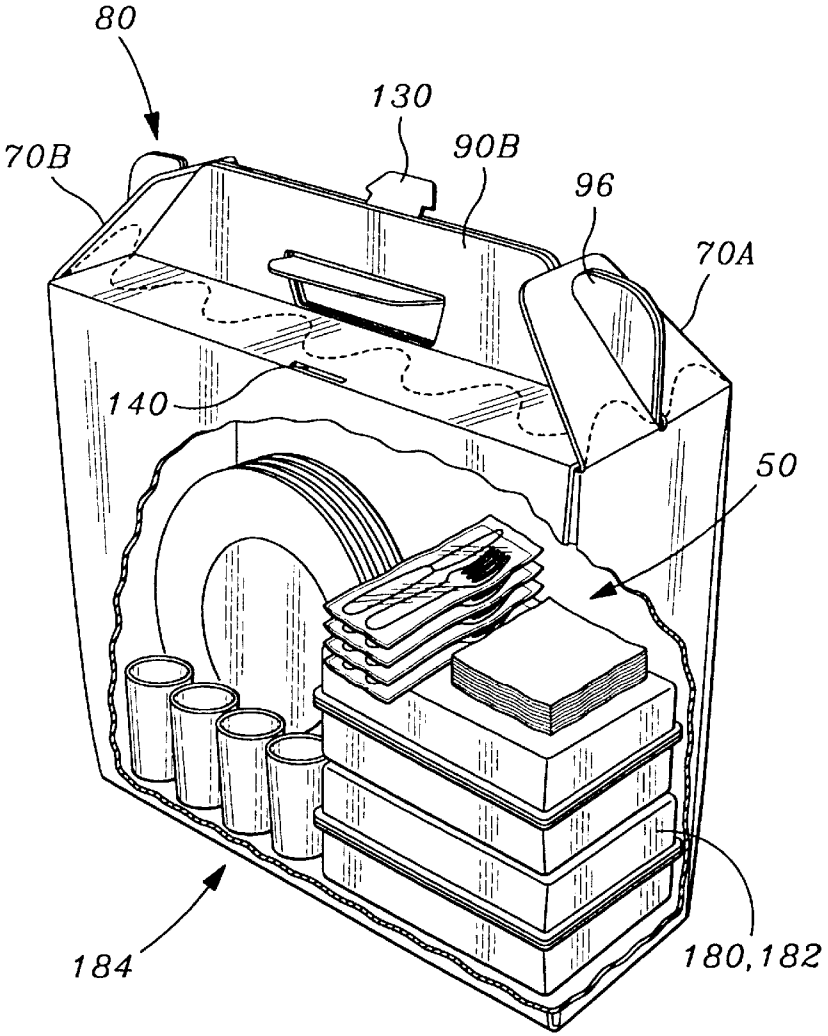
FIG. 2 is a perspective view thereof configured for hand carrying and showing, through a partial sidewall cutaway, typical items within the container.
Figure 1:
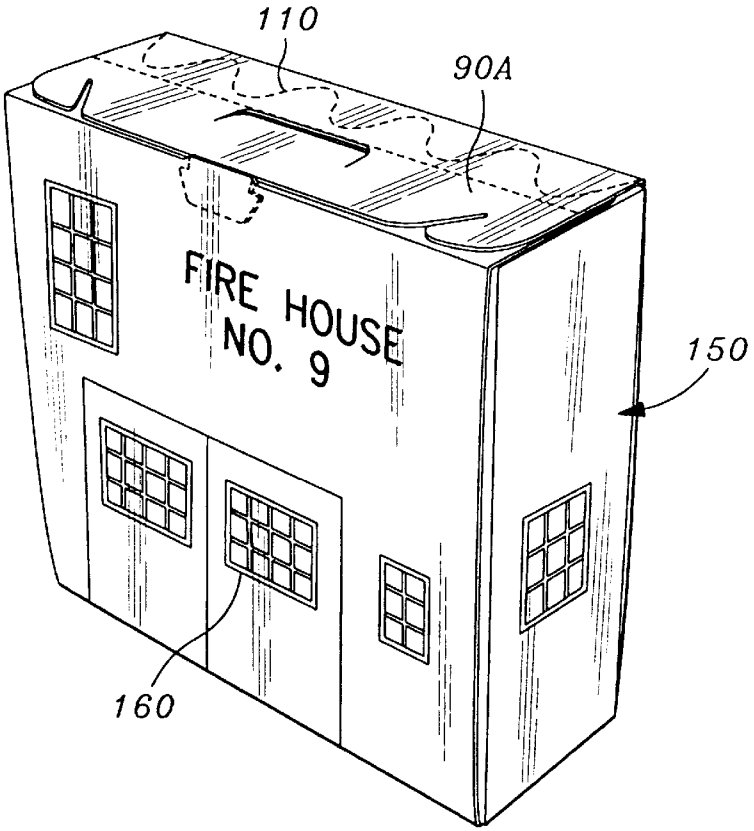
FIG. 1 is a perspective view of the preferred embodiment of the present invention, a container, configured for shipping.
Figure 3:
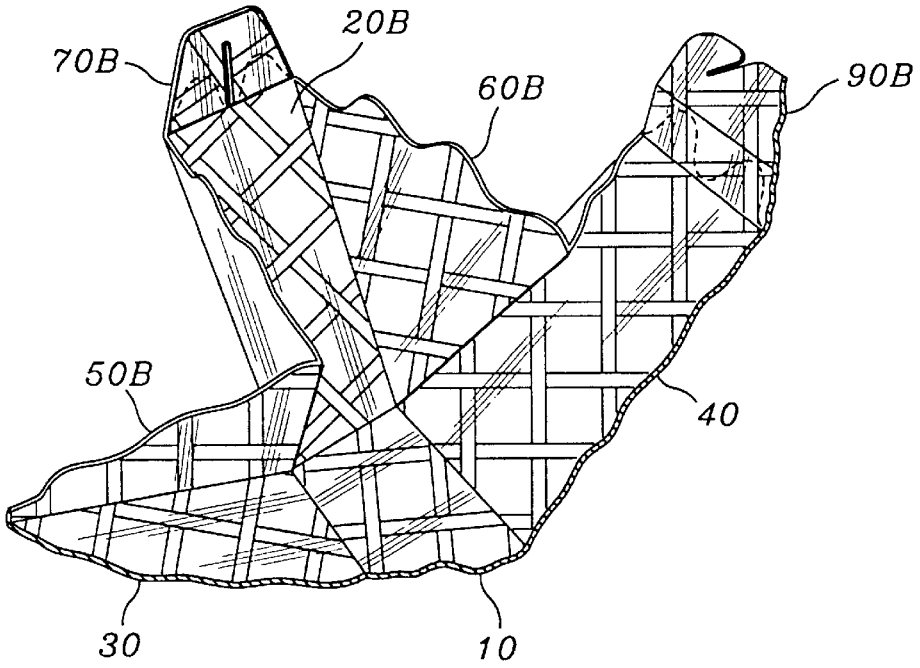
FIG. 3 is a perspective view thereof showing one end of the container in a partially folded-open configuration.
Figure 5:
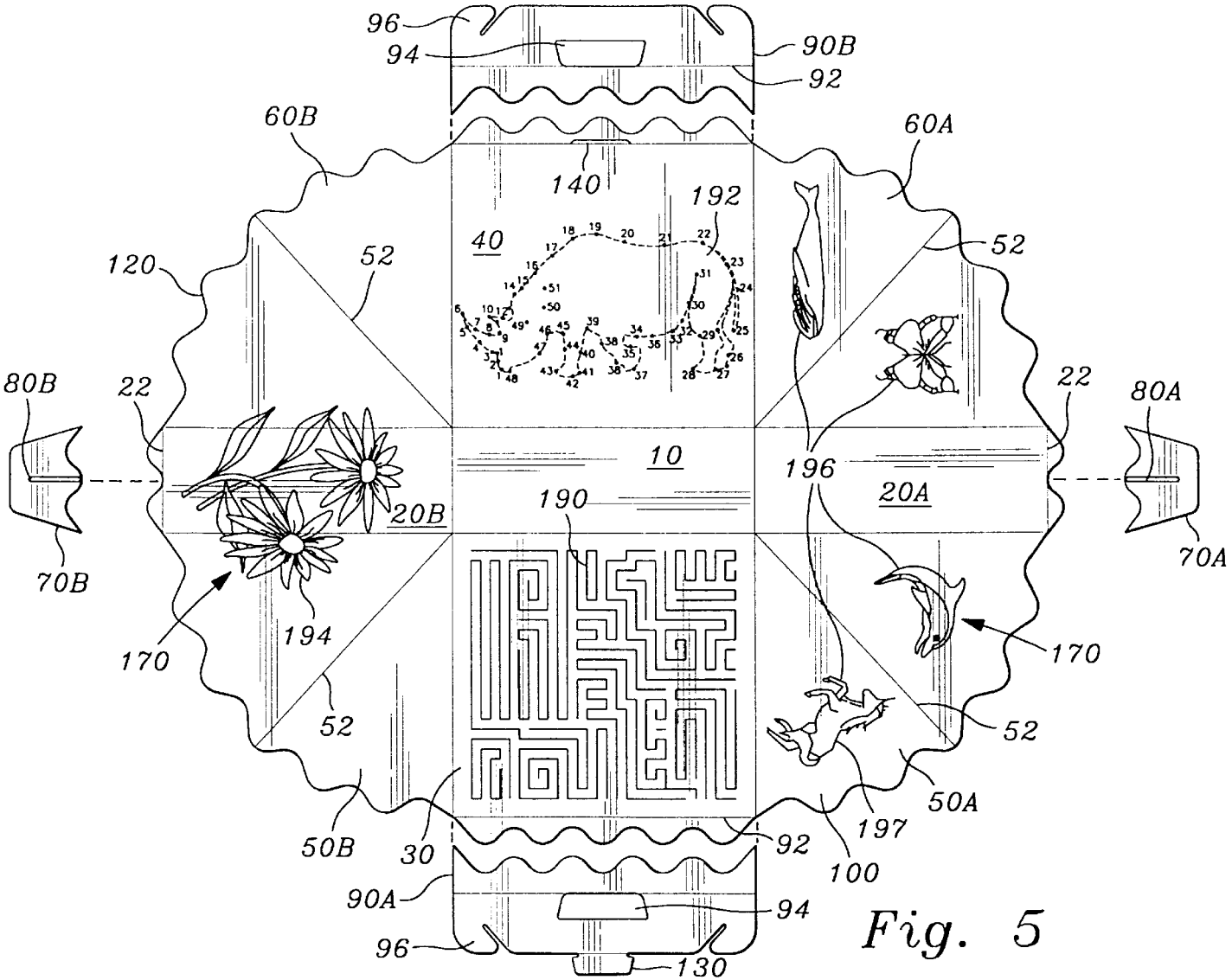
FIG. 5 is a plan view of the mat of FIG. 4, with certain elements thereof shown disconnected, and with an alternate indicia showing a game board.

FIG. 5 illustrates the basic construction of the invention, a combination use container comprising a rectangular bottom wall 10 having, foldably joined thereto, a pair of side walls 20A and 20B, a front wall 30, and a back wall 40; the walls being foldably positionable, in a closed configuration of the container, for enclosing a storage space 50 therewithin. A first pair of corner flaps 50A and 50B are positioned for foldably joining the front wall 30 to the pair of side walls 20A and 20B. A second pair of corner flaps 60A and 60B are positioned for foldably joining the rear wall 40 to the pair of side walls. The four corner flaps 50A and B, and 60A and B, are preferably articulated through flap fold lines 52 so that the flaps are positioned inside the storage space 50 when the container is folded into a box shape as shown in FIGS. 1 and 2. This is a novel aspect of the invention; that the box shape is attained using a single continuous portion of sheet plastic or cardboard.

A pair of opposing locking flaps 70A and 70B are provided, with one of the locking flaps being foldably joined along the top edge 22 of each one of the side walls 20A, 20B. The locking flaps 70A, B each provide a first part 80A of a locking means 80 preferably a locking slot. A pair of opposing handle flaps 90A and 90B are foldably joined, one of the flaps to each one of the front 30 and back 40 walls respectively, again, along their top edges 92, and are positionable for fully covering the storage space as shown in FIG. 1. The handle flaps 90A, B each provide a hand-sized aperture 94 for carrying the container. The handle flaps form a second part 96 of the locking means 80 as each of the handle flaps provides a hook-shaped portion which may be inserted into one of the locking slots 80A, B. In this manner, the first part 80A and the second part 96 of the locking means are mutually engagable for locking the container in a closed orientation, as shown in FIG. 2.

Figure 4:
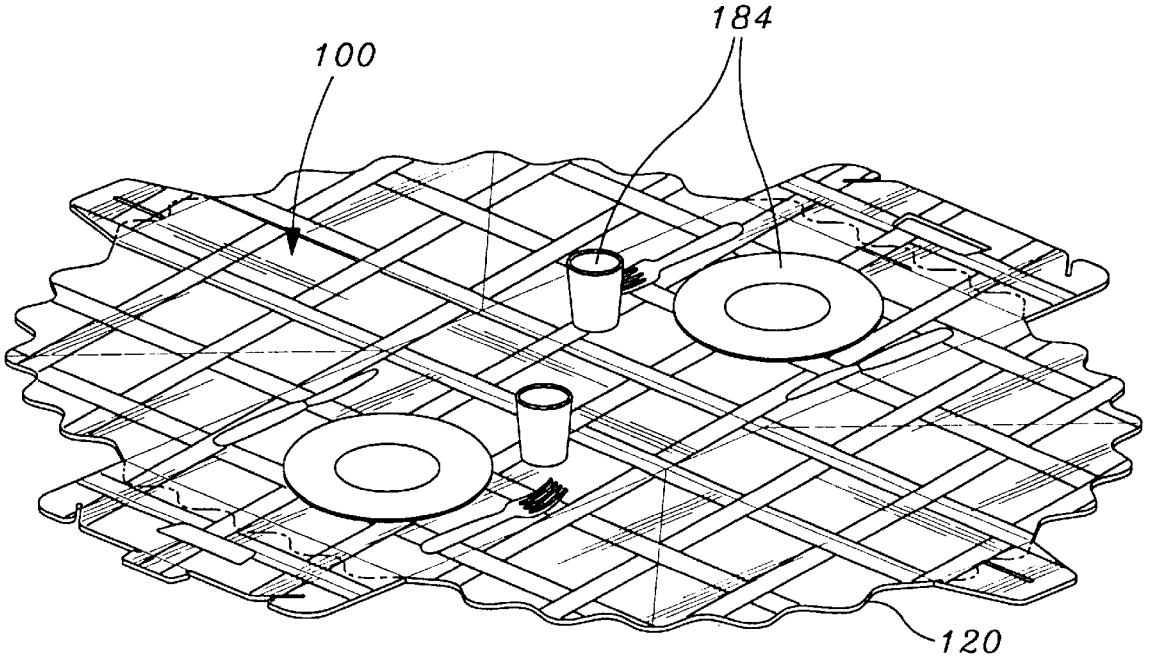
FIG. 4 is a perspective view thereof with the invention is a fully folded-open configuration for use as an eating mat and depicting a table cloth indicia.

The pair of side walls 20A, B, the front wall 30, the back wall 40 and the corner flaps 50 and 60A, B, are foldably positionable, in an open configuration of the container, in a common plane, as shown in FIG. 4, as an activity mat. The surface 100 of the mat is preferably moisture impermeable and clean so that it may be used as an eating surface and also so that the material of which the container is constructed, preferably cardboard, will not be damaged by liquids in contact with it. Moisture impermeability is obtained preferably through the use of a moisture barrier layer on the mat surface 100, or by impregnating a moisture resistance substance into the surface 100. Preferably, a means for tearing away 110 at least a portion of each of the locking flaps 70A, B and the handle flaps 90A, B from the mat so that the mat provides a consistent and uniform peripheral edge 120. Such a means may comprise perforations or scores as shown by lines 110 in FIG. 1. This is shown in FIG. 5 wherein, with the portions torn away, the mat may be more easily used and the edge 120 is quite uniform, in the preferred embodiment as a scalloped edge. The edge 120 may also define other shapes including oval or square. Preferably, too, one of the handle flaps 90A provides a foldably positionable locking tab 130 extending outwardly therefrom, as best seen in FIG. 5, and the other of the handle flaps 90B provides a corresponding positioned, opposing locking slot 140. The locking tab 130 may be inserted into the locking slot 140 for configuring the container for shipping when the handle flaps 90A, B, are laid, one over the other as shown in FIG. 1.

An exterior surface 150 of the container preferably provides a first indicia 160 whereby the container, when configured in the closed state (FIG. 1), resembles a building such as a firehouse, home, barn or other recognizable construction. Such indicia 160 are preferably applied when the container is used for carrying and using toys, games or arts and crafts materials, etc. In such an embodiment, the container may be used for shipping such a product when configured as a shipping container as shown in FIG. 1, it may then be used as a means for carrying the product when used for carrying toys and games to a park, for instance, as shown in FIG. 2, and it may also be used as an eating, game or work mat when at the park, i.e., laid out as shown in FIG. 5. When play time is over, the container may be used to gather-up the toys and games and store them for later use and to carry them home again. When used in this way a second indicia 170 on the interior surface 100 of the container should correlate with the first indicia 160 on the exterior. For example, the firehouse indicia shown in FIG. 1 would correlate with a second indicia on the interior surfaces such as a plan layout of a city showing streets and buildings and where the container might carry vehicle toys such as cars and trucks and including a fire truck (not shown). In the same manner the exterior and interior indicia 160, 170 of the container, and the materials supplied within the container, would preferably be correlated with respect to any one of many possible themes. Indicia 160, 170 are preferably printed or screened onto the container.

Alternately, the container may be used in combination with a prepared edible 180 such as fried chicken and potato salad for a picnic, where such an edible 180 is held within a prepared edible container means 182 such as a disposable covered dish, and further in combination with a dining facilitation means 184 such as paper plates, and cups, plastic eating utensils and napkins, etc., the container, when in the closed configured, providing storage and portage for the prepared edible 180, prepared edible container means 182 and the dining facilitation means 184 as shown in FIG. 2. The container, when in the open, and laid-flat configured, providing a surface 100 (FIG. 4) for holding the prepared edible container means 182 and the dining facilitation means 184 in a typical layout, such as shown in FIG. 4, for dining. When used as such, the interior surface 100 of the container may provide the second indicia 170, such that the mat resembles a table cloth, table top, or other appropriate appearance. The mat may also be configured in the same way as an individual place mat for a single meal.

Still further, the interior surface 100 of the container may provide the second indicia 170 whereby the container, when configured in the open state, may be used as an activity mat. Such an activity mat may include a maze type puzzle 190, a connect-the-dots type puzzle 192; a picture of the type for coloring 194, or one or more figures 196 adapted, by being pre-scored around a periphery 197, for separation from the container by cutting-out or punching-out. Other possible second indicia 170 may be printed or laminated to the interior surface of the container for enabling the container to be used in various ways within the spirit of the present invention.

Generally, the exterior surface 150 of the container provides a first indicia 160 functional with the container positioned in the closed state and wherein the interior surface 100 of the container provides a second indicia 170, corresponding to the first indicia 160 and functional with the container positioned in the open state. The container preferably further includes a contained item 184 therewithin, the first and second indicia corresponding, in theme. to the contained item 184. As for example, as described above, the interior surface may be printed to resemble a tablecloth, the contained item may be as shown in FIG. 2, food and eating utensils, and the external surface 150 might be printed with the second indicia 170, a picture of a roast turkey or other food theme pictorial (not shown).

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination use container comprising:

a rectangular bottom wall having foldably joined thereto, a pair of side walls, a front wall, and a back wall, the walls being foldably positionable, in a closed state of the container, for enclosing a storage space therewithin and defining a height of the container;

a first pair of corner flaps foldably joining the front wall to the pair of side walls over the full height of the container;

a second pair of corner flaps foldably joining the rear wall to the pair of side walls over the full height of the container;

a pair of opposing locking flaps, one of the locking flaps being foldably joined to each one of the side walls, each of the locking flaps providing a first part of a locking means;

a pair of opposing handle flaps, one of the handle flaps being foldably joined to each one of the front and back walls respectively and positioned for jointly forming a cover over the storage space, the handle flaps each providing a hand-sized aperture for carrying the container, and a second part of the locking means;

the first part and the second part of the locking means being mutually engagable for locking the cover in place on the container;

the pair of side walls, the front wall, the back wall and the corner flaps being foldably positionable, in an open state of the container, in a common plane as an activity mat;

the container further including a means for tearing away at least a portion of each of the locking flaps and the handle flaps from the activity mat so that the activity mat provides a consistent and uniform peripheral edge.

2. The container of claim 1 wherein a surface of the activity mat is moisture impermeable so as to be useful for eating upon.

3. The container of claim 1 wherein one of the handle flaps provides a foldably positionable locking tab of the locking means extending outwardly therefrom and the other of the handle flaps provides a correspondingly positioned opposing locking slot of the locking means, the locking tab being insertable into the locking slot for configuring the container for shipping.

4. The container of claim 1 in combination with a prepared edible held within a prepared edible container, and further in combination with a dining facilitation means, the container, when positioned in the closed state, providing storage for the prepared edible, prepared edible container means and the dining facilitation means, the container, when positioned in the open state, providing a surface for the prepared edible container means and the dining facilitation means in a layout for dining.

5. The container of claim 4 wherein the dining facilitation means includes a plurality of plates, cups and eating utensils.

6. The container of claim 1, wherein an exterior surface of the container provides a first indicia functional with the container positioned in the closed state and wherein the interior of the container provides a second indicia, corresponding to the first indicia and functional with the container positioned in the open state.

7. The container of claim 6 further including a contained item therewithin, the first and second indicia corresponding, in theme to the contained item.

8. The container of claim 6 wherein the second indicia resembles a table cloth.

9. The container of claim 6 wherein the second indicia provides activities.

10. The container of claim 9 wherein the activities include a maze type puzzle.

11. The container of claim 9 wherein the activities include a connect-the-dots type puzzle.

12. The container of claim 9 wherein the activities include a picture of the type for coloring.

13. The container of claim 9 wherein the activities include at least one figure adapted for separation from the container.

* * * * *